US006290249B1

(12) United States Patent
Wolf

(10) Patent No.: US 6,290,249 B1
(45) Date of Patent: Sep. 18, 2001

(54) SNOW-GLIDING APPARATUS

(75) Inventor: Andrew Wolf, Cornelius, OR (US)

(73) Assignee: Premier Snowskate, Inc., Hillsboro, OR (US)

( * ) Notice: Subject to any disclaimer, the term of this patent is extended or adjusted under 35 U.S.C. 154(b) by 0 days.

(21) Appl. No.: 09/518,231

(22) Filed: Mar. 2, 2000

(51) Int. Cl.[7] ..... A63C 5/99

(52) U.S. Cl. ..... 280/609; 280/14.21; 280/87.042; 280/600

(58) Field of Search ..... 280/609, 14.21, 280/87.042, 11.12, 600, 11.14, 18, 28

(56) References Cited

U.S. PATENT DOCUMENTS

| | | | | |
|---|---|---|---|---|
| D. 263,035 | | 2/1982 | Frechette . | |
| D. 308,711 | | 6/1990 | Katz . | |
| D. 376,561 | | 12/1996 | Sloss . | |
| D. 417,250 | | 11/1999 | Colin . | |
| 3,332,697 | | 7/1967 | Hagen . | |
| 3,372,945 | | 3/1968 | Salisbury . | |
| 3,374,003 | * | 3/1968 | Fulsom | 280/609 |
| 3,378,274 | | 4/1968 | Poppen . | |
| 3,381,972 | * | 5/1968 | Miller | 280/609 |
| 3,534,972 | * | 10/1970 | Salerno | 280/609 |
| 3,614,116 | | 10/1971 | Haldemann . | |
| 3,655,211 | | 4/1972 | Bollettieri et al. . | |
| 3,782,745 | | 1/1974 | Stoveken . | |
| 3,827,096 | * | 8/1974 | Brownson | 280/11.13 |
| 3,918,114 | * | 11/1975 | Schmitt | 280/609 |
| 4,028,761 | | 6/1977 | Taylor . | |
| 4,147,377 | * | 4/1979 | Plenk | 280/609 |
| 4,241,929 | | 12/1980 | Curry . | |
| 4,305,603 | * | 12/1981 | Muller et al. | 280/609 |
| 4,409,287 | | 10/1983 | Harrison . | |
| 4,509,771 | * | 4/1985 | Nussbaumer | 280/609 |
| 4,533,150 | * | 8/1985 | Hardy | 280/609 |
| 4,635,954 | | 1/1987 | Arnsteiner . | |
| 4,840,590 | * | 6/1989 | Kelley | 441/74 |
| 5,328,200 | | 7/1994 | Pelizzari . | |
| 5,437,755 | | 8/1995 | Lavorel et al. . | |
| 5,868,405 | | 2/1999 | Lavecchia et al. . | |
| 5,924,718 | | 7/1999 | Gordon et al. . | |

FOREIGN PATENT DOCUMENTS

| | | |
|---|---|---|
| 197 12 569 A1 | 10/1998 | (DE) . |
| WO 98/42418 | 10/1998 | (WO) . |

* cited by examiner

*Primary Examiner*—Frank Vanaman
*Assistant Examiner*—James S. McClellan
(74) *Attorney, Agent, or Firm*—Kolisch Hartwell Dickinson McCormack & Heuser

(57) ABSTRACT

A snow-gliding apparatus is provided. The snow-gliding apparatus includes an elongate member having an intermediate portion positioned between a pair of upturned end portions, and a bottom surface with a substantially planar bottom region configured to slide over snow. The apparatus further includes a traction member positioned above the elongate member, and a channel extending at least partially along the bottom surface of the elongate member. The channel is configured to guide the elongate member over the snow. The traction member typically is a pliant foam layer. A plurality of channels may be formed in the bottom surface of the elongate member.

26 Claims, 3 Drawing Sheets

10
12
14
16
18a
18b
20
22
22a
22b
22c
24
24a
24b
24c
24d
26
28a
28b
30
32
34a
34b
36a
36b
36c
36d
7

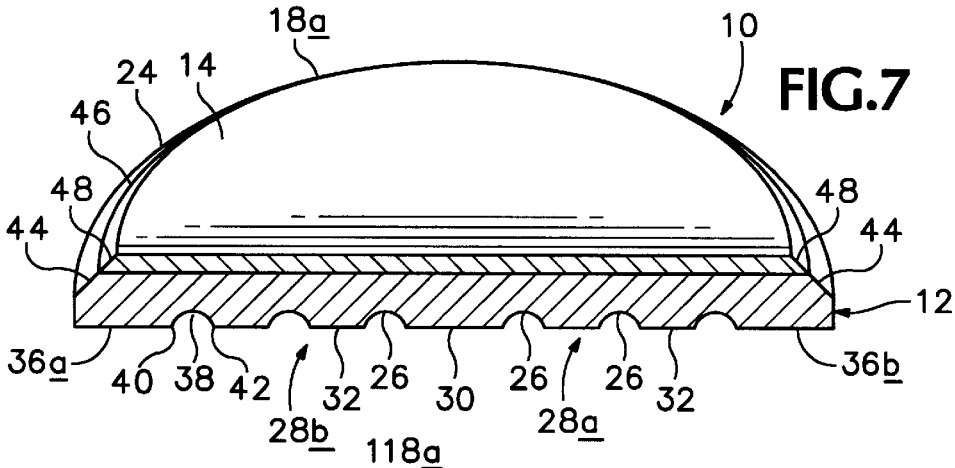
FIG.7
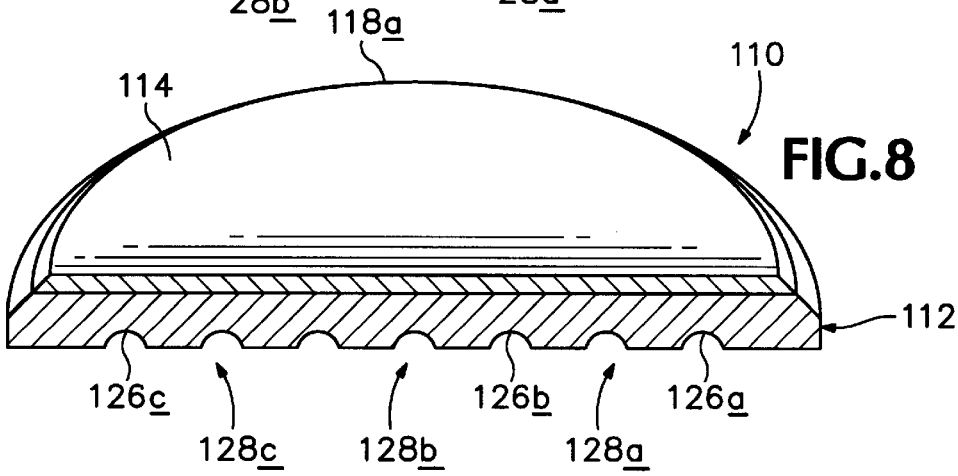
FIG.8
FIG.9
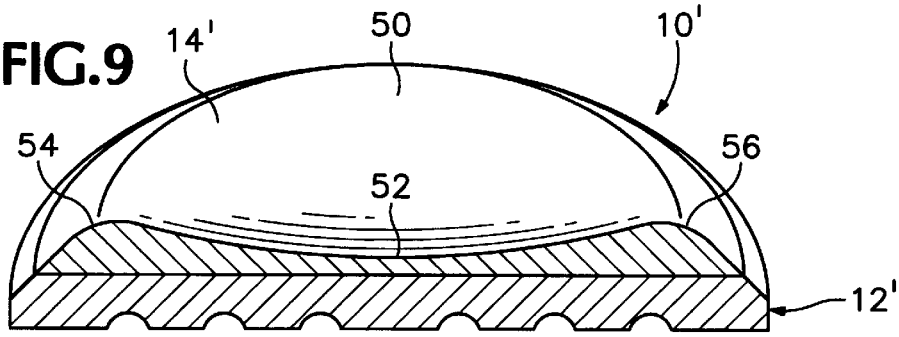
FIG.10
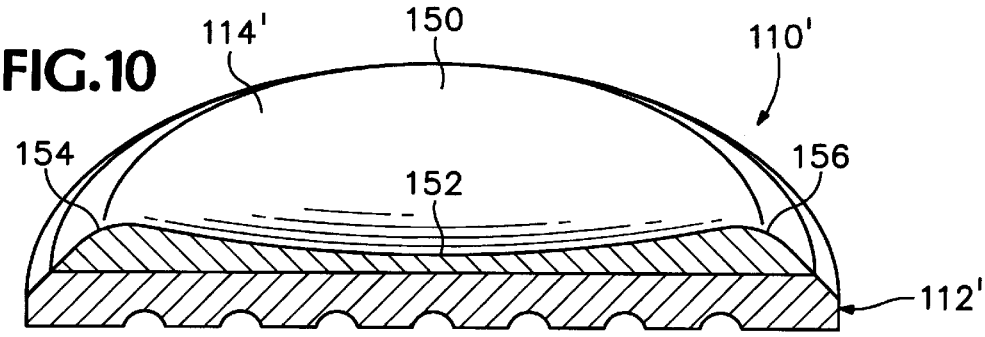

SNOW-GLIDING APPARATUS

TECHNICAL FIELD

This invention relates generally to winter sports equipment, and more particularly to snow-gliding sports equipment.

BACKGROUND OF THE INVENTION

The sports of skateboarding and snowboarding have reached new heights of popularity in recent years. A skateboard includes a board with wheels attached to the underside, and is designed for riding on a sidewalk or in a specially designed skatepark. A snowboard includes a board with a waxed underside and bindings for securing the feet of a rider to the snowboard, and is designed primarily for riding on a snow-covered slope or in a specially designed snowpark.

Riding a skateboard is similar to riding a snowboard in that the rider assumes a sideways stance on both types of boards. However, one primary difference is that, in skateboard riding, the rider's feet are free to leave the surface of the skateboard, whereas in snowboarding, the rider's feet remain securely attached to the snowboard. Skateboard riding has evolved to include a host of well known tricks such as ollies, kickflips, shovits, etc., which take advantage of the ability to remove the rider's feet temporarily from the skateboard during performance of the trick. These tricks are not able to be performed on current snowboards because the bindings prevent the rider's feet from leaving the snowboard.

One problem with current skateboards is that they are unable to be ridden successfully on snow, because the wheels of the skateboards dig into the snow and cause the skateboards to stop suddenly. Attempts to ride skateboards on snow generally result in crashes. For riders who reside in cold-weather climates, this renders skateboards unusable outdoors during the snowy season, which may last for many months.

It would be desirable to provide an apparatus that is capable of being ridden in the snow, and that is configured to allow temporary removal of a rider's feet from the apparatus, to enable a rider to perform a wide variety of maneuvers.

SUMMARY OF THE INVENTION

A snow-gliding apparatus is provided. The snow-gliding apparatus includes an elongate member having an intermediate portion positioned between a pair of upturned end portions, and a bottom surface with a substantially planar bottom region configured to slide over snow. The apparatus further includes a traction member positioned above the elongate member, and a channel extending at least partially along the bottom surface of the elongate member. The channel is configured to guide the elongate member over the snow. The traction member typically is a pliant foam layer. A plurality of channels may be formed in the bottom surface of the elongate member.

BRIEF DESCRIPTION OF THE DRAWINGS

FIG. 7 is a cross-sectional view of the embodiment of FIG. 1, taken along line 7—7 of FIG. 3.

FIG. 8 is a cross-sectional view of the embodiment of FIG. 4, taken along line 8—8.

FIG. 9 is a cross-sectional view of a snow-gliding apparatus according to another embodiment of the invention including two channel groups and a traction member with a concave top surface.

FIG. 10 is a cross-sectional view of a snow-gliding apparatus according to another embodiment of the invention including a three channel groups and a traction member with a concave top surface.

DETAILED DESCRIPTION OF THE PREFERRED EMBODIMENTS

Figures 1, 2, 3:
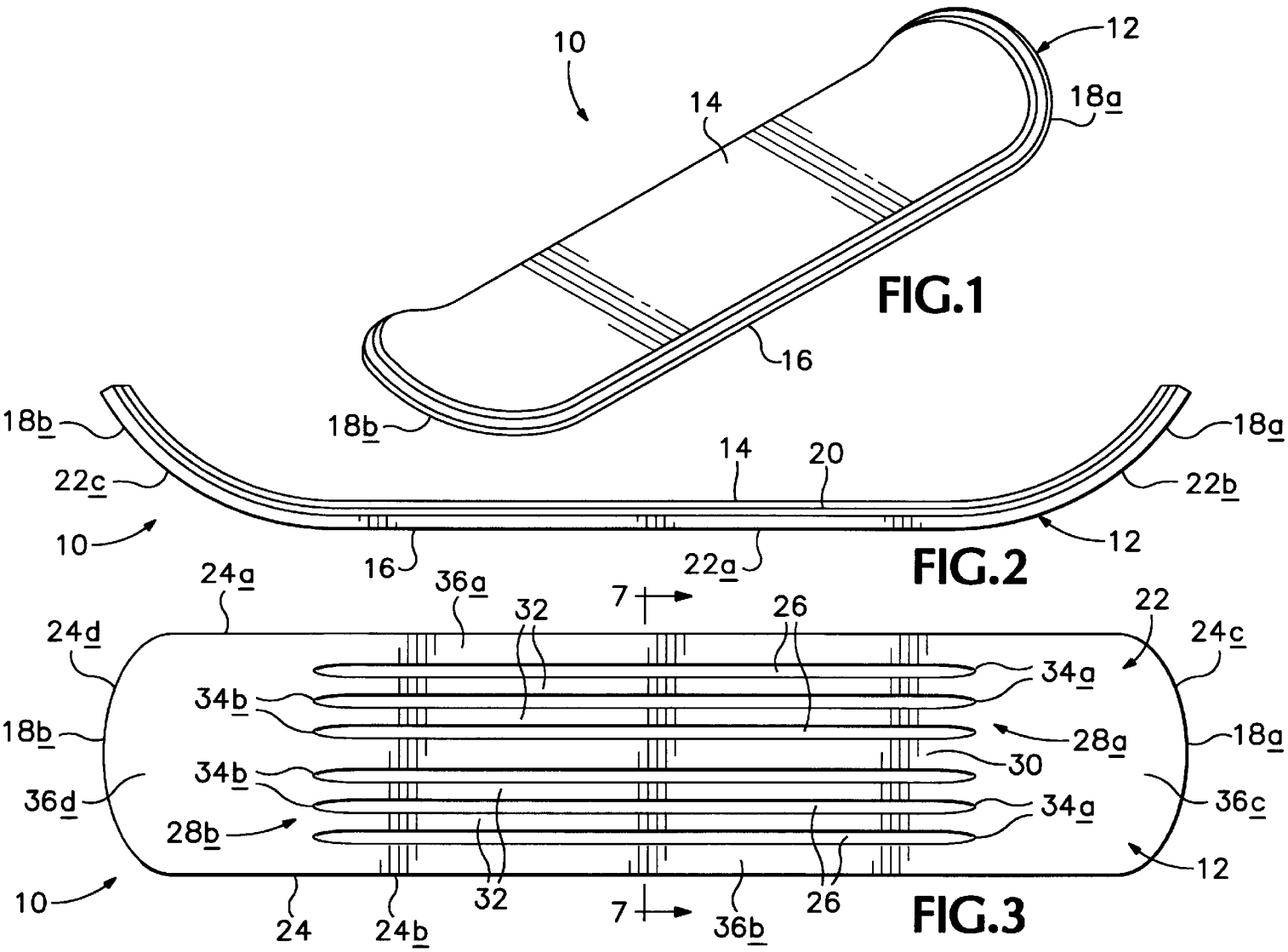
FIG. 1 is an isometric view of a snow-gliding apparatus according to one exemplary embodiment of the present invention.
FIG. 2 is a side view of the embodiment of FIG. 1.
FIG. 3 is a bottom view of the embodiment of FIG. 1.

Referring initially to FIGS. 1–3, a snow-gliding apparatus according to the present invention is shown generally at 10. Snow-gliding apparatus 10 typically includes an elongate member 12 configured to slide over snow, and a traction member 14 configured to provide traction for the boots or shoes of a rider.

Elongate member 12 includes a substantially flat intermediate portion 16 and opposite upturned end portions 18*a,* 18*b,* also referred to as leading end portion 18*a* and trailing end portion 18*b*. Leading and trailing end portions 18*a,* 18*b* each include a respective inward end positioned adjacent a corresponding outer end of intermediate portion 16. Leading and trailing end portions 18*a,* 18*b* typically each extend outward from the intermediate portion 16 in a continuously curved shape. Alternatively, the leading and trailing end portions 18*a,* 18*b* may be polygonal, or may have another curved shape. Typically, the upturned end portions 18*a,* 18*b* are symmetric. Alternatively, the upturned end portions may be formed in different shapes.

Elongate member 12 includes a top surface 20 and a bottom surface 22. The bottom surface includes a substantially planar bottom region 22*a,* typically extending along a bottom side of intermediate portion 16 of the elongate member 12. It will be understood that substantially planar bottom region may include a camber. Elongate member 12 is typically made of high-density polyethylene material. Alternatively, the elongate member may be constructed partially or wholly from a translucent material such as polycarbonate or LEXAN. For example, the elongate member may include an upper layer of high density polyethylene, with a graphical design imprinted on its bottom surface, followed a lower layer of translucent material, such that the graphical design is viewable from the bottom of the elongate member through the translucent material.

Bottom surface 22 further includes a leading upturned bottom region 22*b* and a trailing upturned bottom region 22*c* each extending along an underside of upturned end portions 18*a* and 18*b,* respectively. Typically, both leading upturned bottom region 22*b* and trailing upturned bottom region 22*c* are shaped in a continuous curve originating at an inward end of the respective upturned bottom region, which is positioned at the intersection of the respective upturned bottom region 22*b,* 22*c* and the substantially planar bottom region 22*a*. Alternatively, the upturned bottom regions may be straight, polygonal, or curved in another shape.

As shown in FIG. 3, elongate member 12 is surrounded by an outer edge 24, which includes left and right edges 24*a,*

24*b* and leading and trailing end edges 24*c* and 24*d*. typically, the outer edge 24 is rounded in the region of ends edges 24*c* and 24*d* and straight in the region of side edges 24*a* and 24*b*. Alternatively, the end edges may be straight or polygonal, and/or the side edges may be curved or polygonal.

Apparatus 10 typically includes a plurality of elongate channels 26 organized into first and second channel groups 28*a*, 28*b* separated by a dividing portion 30 . First and second channel groups 28*a*, 28*b* are also referred to as left and right channel groups 28*a*, 28*b*, respectively. Channels 26 are separated from each other within channel groups 28*a*, 28*b* by a plurality of channel-separating portions 32. Channel groups 28*a*, 28*b* are typically positioned in an interior region of the bottom surface 22 of elongate member 12.

Each of channels 26 typically extends lengthwise along the substantially planar bottom region 22*a* of the bottom surface of the apparatus, from the inward end of leading end portion 18*a* to the inward end of trailing end portion 18*b*. Each channel 26 includes a pair of leading and trailing rounded end portions 34*a* and 34*b* formed at each end of the channel. Typically, elongate member 12 is formed from a flat sheet of material, which first is bent to form upturned end portions 18*a*, 18*b* and later is cut horizontally with a router or other device to form elongate channels 26. This produces rounded end portions 34*a* and 34*b* in the bends adjacent the inner end of upwardly turned end portions 18*a* and 18*b*.

Bottom surface 22 typically includes left-side and right-side surface portions 36*a*, 36*b*, and leading end and trailing end surface portions 36*c* and 36*d*. Surface portions 36*a*, 36*b*, 36*c*, and 36*d* typically are smooth, and do not include channels or projections.

Figure 5:
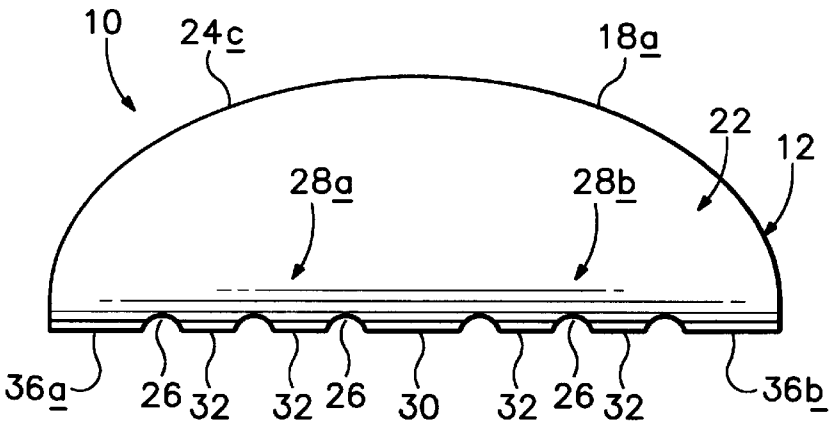
FIG. 5 is a front end view of the embodiment of FIG. 1.

Channels 26 typically open to the leading end of the apparatus, as shown in FIG. 5, as well as to the trailing end of the apparatus, which typically is symmetric to the leading end shown in FIG. 5. As the apparatus passes over a snow-covered surface, snow under channels 26 is guided into the channels, while snow under substantially planar regions of bottom surface 22 is compacted. Thus, snow under channel-group dividing portion 30, channel-separating portions 32, and right-side and left-side surface portions 36*a*, 36*b*, is compacted. Snow within channels 26, if compacted at all, is not compacted so much as snow under the planar regions of bottom surface 22. This creates ridges in the snow, along which channels 26 are configured to slide. The sliding of the snow ridges within channels 26 tends to cause the apparatus to slide in a straight path, thereby making the apparatus easier to ride.

Typically, each of channel groups 28*a*, 28*b* includes three channels. It also will be appreciated that either of channel groups 28*a*, 28*b* alternatively may include one, two, four, or a greater number, of channels. In addition, while apparatus 10 typically includes two channel groups, it will be appreciated that apparatus 10 may include a single channel group, or three or more channel groups. Apparatus 10 may, for example, include a single channel group having a single channel.

As shown in FIG. 7, each of channels 26 includes an interior surface 38 that is semi-circular (preferably hemispherical) in cross-section. Each of channels 26 further includes a pair of sharp edges 40, 42 along the intersections between the respective interior surface 38 of each channel and bottom surface 22 of elongate member 12. Sharp edges contribute to the ability of the channel to guide the apparatus over snow. Alternatively, interior surface 38 of channels 26 may be polygonal (e.g. triangular or square) or rounded according to some other predetermined curve, such as an ellipse. In addition, it will be appreciated that edges 40 and 42 may include a radius, bevel, or chamfer, and may not be sharp.

Elongate member 12 typically includes a bevel 44 along its outer edge 24. Traction member 14 also typically includes an outer edge 46 including a bevel 48. Usually, bevels 44 and 48 are formed at a common angle. Alternatively, each bevel may have a different angle. In addition, will be appreciated that elongate member 12 and traction member 14 may not include any bevel at all.

Traction member 14 typically is a pliant layer of a foam material. In one exemplary embodiment of the invention, the foam material is a closed-cell ethylene vinyl acetate material. Alternatively, virtually any other suitable pliant material may be used, including other open or closed-cell foams, or rubber materials, etc. In addition, it will be understood that the traction member may not be pliant, and may not be a foam material. Traction member 14 also typically includes an adhesive backing that adheres to elongate member 12. Alternatively, virtually any other suitable adhesive method (e.g., glues, fasteners, cements, etc.) may be used to secure traction member 14 to elongate member 12.

Traction member 14 typically is positioned on each of intermediate portion 16 and upturned end portions 18*a*, 18*b* of elongate member 12, and covers a substantial portion of top surface 20 of elongate member 12, typically all of the top surface. In the embodiment of FIG. 1, traction member 14 extends from left-side edge 24*a* a to right-side edge 24*b* and from leading edge 24*c* to trailing edge 24*d* and covers all of top surface 20. Thus, a rider may step virtually anywhere on the top of the apparatus and contact the traction member 14.

Alternatively, traction member 14 may not extend entirely from left-side edge 24*a* to right-side edge 24*b*, or from leading edge 24*c* to trailing edge 24*d*, and may not be positioned on each of intermediate portion 16 and upturned end portions 18*a*, 18*b*. Typically traction member 14 is a continuous sheet of material. Alternatively, traction member 14 may be perforated or include gaps, and may not be continuous.

Referring to FIG. 9, a snow-gliding apparatus according to another embodiment of the invention is shown generally at 10'. Except as described below, the above description of apparatus 10 applies equally to apparatus 10', and, for the sake of brevity, common elements between apparatus 10 and 10' will not be redescribed in detail.

Apparatus 10' includes an elongate member 12' and a traction member 14'. Traction member 14' has an upwardly curved top portion 50, also referred to as concave portion 50. Concave portion 50 typically includes a well 52 surrounded by ridges 54 and 56. Concave portion 50 typically extends along the length of a substantially flat intermediate portion of elongate member 12', and into upwardly turned end portions of the elongate member 12'. Alternatively, the concave portion 50 may be contained entirely within the intermediate portion, or may extend only between a single upwardly turned end portion and the flat intermediate portion. The ridges improve the traction of the rider on the traction member 14'.

Figure 4:
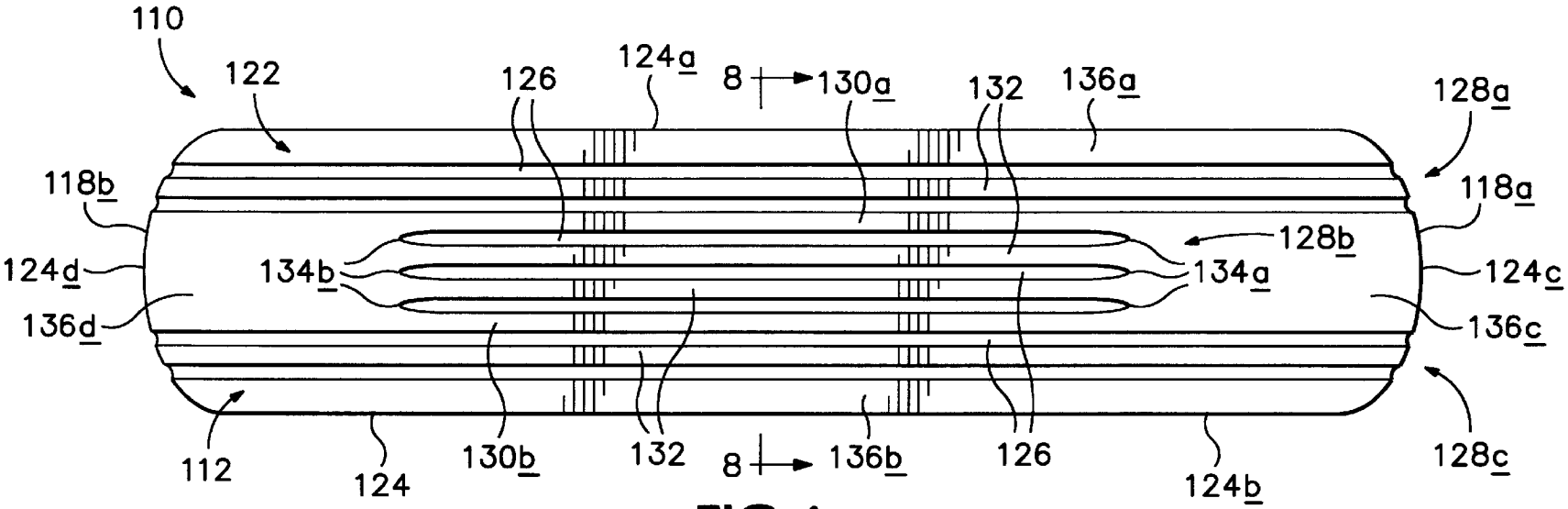
FIG. 4 is a bottom view of a snow-gliding apparatus according to another embodiment of the invention.
Figure 6:
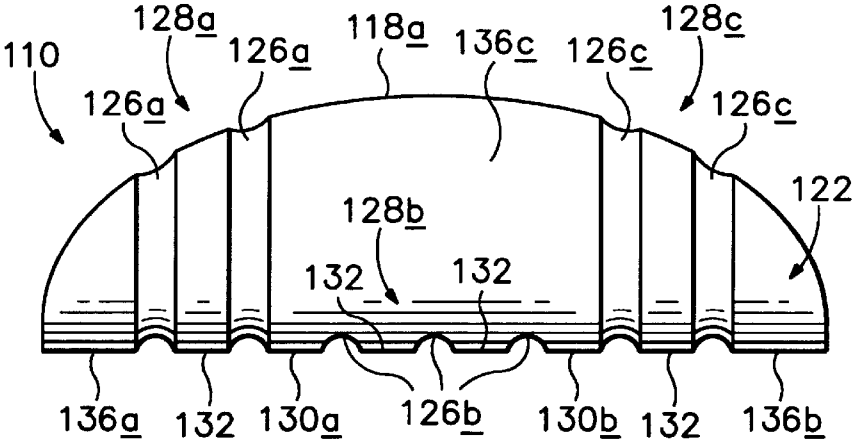
FIG. 6 is a front end view of the embodiment of FIG. 4.

FIGS. 4, 6, and 8 show a snow-gliding apparatus according to another exemplary embodiment of the invention, indicated generally at 110. Except as described below, the above description of apparatus 10 applies equally to apparatus 110, and, for the sake of brevity, common elements between apparatus 10 and 110 will not be redescribed in detail. Corresponding elements of apparatus 10 and apparatus 110 are indicated by reference indicators that differ by 100.

Apparatus 110 includes an elongate member 112 with a bottom surface 122 and an outer edge 124 including left-side and right-side edges 124*a*. 124*b*, and leading and trailing edges 124*c*, 124*d*. Bottom surface 122 has a plurality of elongate channels 126 formed therein, which are organized into first, second, and third spaced-apart channel groups 128*a*, 128*b*, 128*c*, respectively.

First and third channel groups 128*a*, 128*c* are positioned on opposite sides of second channel group 128*b*, intermediate second channel group 128*b* and a respective left- or right-side edge 124*a*, 124*b*. The channels within channel groups 128*a*, 128*b*, and 128*c* are referred to as channels 126*a*, 126*b*, and 126*c*, respectively. The first, second, and third channel groups 128*a*, 128*b*, and 128*c* also are referred to as the left channel group 128*a*, central channel group 128*b*, and right channel group 128*c*, respectively.

Apparatus 110 further includes a first channel-group dividing portion 130*a* positioned intermediate channel groups 128*a* and 128*b*, and a second channel-group dividing portion 130*b* positioned intermediate channel groups 128*b* and 128*c*. Apparatus 110 further includes a plurality of channel-separating portions 132, each channel-separating portion 132 being positioned between an adjacent pair of channels within channel group 128*a*, 128*b*, or 128*c*.

Typically, left channel group 128*a* and right channel group 128*c* each includes two channels, and central channel group 128*b* includes three channels. Alternatively, a different predetermined number of channels may be used for each of the channel groups.

Channels 126*b* of central channel group 128*b* typically include respective leading and trailing rounded end portions 134*a* 134*b*. The leading and trailing end portions 134*a*, 134*b* of channels 126*b* typically are positioned in an interior region of bottom surface 122, adjacent a respective inward end of leading or trailing end portion 118*a*, 118*b*. Thus, channels 126*b* are formed within and internal to bottom surface 122.

Bottom surface 122 typically includes left-side and right-side surface portions 136*a* and 136*b*, as well as leading-end and trailing-end surface portions 136*c* and 136*d*. Surface portions 136*a*, 136*b*, 136*c* and 136*d* typically are smooth, and do not include channels or protrusions. Each of leading-end surface portion 136*c* and trailing-end surface portion 136*d* is positioned intermediate a respective end 134*a*, 134*b* of the of channels 126*b* and a corresponding end edge 124*c*, 124*d* of the elongate member 12, and intermediate channel groups 128*a* and 128*c*. Each of left-side and right-side surface portions 136*a*, 136*b* is positioned intermediate a respective channel group 128*a*, 128*c* and a corresponding left-side or right-side edge 124*a*, 124*b*.

Channels 126*a*, 126*c* of the left and right channel groups typically are longer than the channels 128*b* of the central channel group, and extend to intersect leading and trailing edges 124*c*, 124*d* of the apparatus. Alternatively, channels 126*a* and/or 126*c* may intersect only one of edges 124*c*, 124*d*, or may not intersect edges 124*c*, 124*d* at all. For example, the ends of channel 126*a* and/or 126*c* may terminate within an interior of upturned end portion 118*a* and 118*b* without intersecting edge 124 of the elongate member 112.

Elongate member 112 typically is formed from a flat sheet of material by first cutting channels 126*a* and 126*c* along the bottom surface of the sheet. Next, the sheet is bent at each end to form upwardly turned end portions 18*a* and 18*b*. Finally, channels 126*b* are cut from the sheet by passing a router or other cutting device horizontally along the bottom surface 122 of the elongate member. As the router passes from the substantially planar region of bottom surface 122 away from the elongate member, rounded end portions 134*a*, 134*b* are formed at the end of each of elongate channels 126*b*.

Referring to FIG. 10, a snow-gliding apparatus according to another embodiment of the invention is shown generally at 110'. Except as described below, the above description of apparatus 110 applies equally to apparatus 110', and, for the sake of brevity, common elements between apparatus 10 and 10' will not be redescribed in detail.

Apparatus 110' includes an elongate member 112' and a traction member 114'. Traction member 114' has an upwardly curved top portion 150, also referred to as concave portion 150. Concave portion 150 typically includes a well 152 surrounded by ridges 154 and 156. Concave portion 150 typically extends the length of a substantially flat intermediate portion of elongate member 112', and into upwardly turned end portions of the elongate member 112'. Alternatively, the concave portion 150 may be contained entirely within the intermediate portion, or may extend only between a single upwardly turned end portion and the flat intermediate portion. The ridges improve the traction of the rider on the traction member 114'.

While the invention has been disclosed in its preferred form, the specific embodiments thereof as disclosed and illustrated herein are not to be considered in a limiting sense because numerous variations are possible. The subject matter of the invention includes all novel and non-obvious combinations and subcombinations of the various elements, features. functions, and/or properties disclosed herein. No single feature, function, element. or property of the disclosed embodiments is essential. The following claims define certain combinations and subcombinations which are regarded as novel and non-obvious. Other combinations and subcombinations of features, functions, elements, and/or properties may be claimed through amendment of the present claims or presentation of new claims in this or a related application. Such claims also are regarded as included within the subject matter of the present invention, irrespective of whether they are broader, narrower, or equal in scope to the original claims.

I claim:

1. A gliding apparatus for use in snow, comprising:

an elongate member including an intermediate portion between a pair of symmetric upturned end portions, the elongate member including a bottom surfaces with a substantially planar bottom region configured to slide over snow;

a pliant foam traction member covering substantially all of an upper surfaces of the elongate member; and a channel extending lengthwise at least partially along the bottom surfaces of the elongate member, the channel being configured to guide the elongate member over the snow;

wherein the apparatus does not include bindings to secure the feet of a rider.

2. The snow-gliding apparatus of claim 1, wherein the foam layer includes closed-cell ethylene vinyl acetate material.

3. The snow-gliding apparatus of claim 1, wherein the traction member includes a concave portion.

4. The snow-gliding apparatus of claim 1, wherein the elongate channel intersects at least one end edge of the elongate member.

5. The snow-gliding apparatus of claim 1, wherein at least one end of the elongate channel terminates adjacent an inward end of one of the upturned end portions.

6. The snow-gliding apparatus of claim 1, wherein the elongate channel is positioned entirely in an interior region of the bottom surface, and does not intersect any edge of the elongate member.

7. The snow-gliding apparatus of claim 1, wherein the elongate channel is open to a first end of the elongate member.

8. The snow-gliding apparatus of claim 1, wherein the elongate channel extends from a leading edge to a trailing edge of the elongate member.

9. The snow-gliding apparatus of claim 1, wherein the elongate member includes a plurality of channels formed lengthwise in the bottom surface of the elongate member.

10. The snow-gliding apparatus of claim 9, wherein at least one of the elongate channels intersects at least one end edge of the elongate member, and another of the elongate channels is formed internal to the bottom surface and does not intersect any edge of the elongate member.

11. The snow-gliding apparatus of claim 1, further comprising:

a first channel group including a plurality of elongate channels formed lengthwise in the bottom surface of the elongate member;

a second channel group including a plurality of elongate channels formed lengthwise in the bottom surface of the elongate member;

wherein the first and second channel groups are separated by a channel group dividing portion.

12. The snow-gliding apparatus of claim 11, wherein the elongate channels of each of the first and second channel groups are formed in an interior region of the bottom surface of the elongate member.

13. The snow-gliding apparatus of claim 11, wherein the elongate channels of the first channel group intersect at least one end edge of the elongate member, and the elongate channels of another of the channel groups are formed internally on the bottom surface of the elongate member, and do not intersect any edge of the elongate member.

14. The snow-gliding apparatus of claim 1, further comprising:

a left channel group including a plurality of elongate channels formed lengthwise in the bottom surface of the elongate member;

a right channel group including a plurality of elongate channels formed lengthwise in the bottom surface of the elongate member; and a central channel group including a plurality of elongate channels formed lengthwise in the bottom surface of the elongate member;

wherein the left and right channel groups each include an elongate channels that intersects an end edge of the elongate member, and the central channel group is formed in an interior region of the bottom surface and does not intersect an edge of the elongate member.

15. The snow-gliding apparatus of claim 1, wherein the elongate channel is semi-circular in cross section.

16. The snow-gliding apparatus of claim 1, wherein the elongate channel and bottom surface meet in a sharp edge.

17. The snow-gliding apparatus of claim 1, wherein the elongate member is made at least partially of a high-density polyethylene material.

18. The gliding apparatus of claim 1, wherein the traction member is a continuous sheet of pliant foam.

19. The gliding apparatus of claim 1, wherein the traction member is perforated.

20. the gliding apparatus of claim 1, wherein the traction member includes one or more gaps.

21. A snow-gliding apparatus, comprising:

an elongate member including a flat intermediate portion and upturned symmetric end portions, the elongate member including a top surface and a bottom surface;

a pliant foam traction member mounted adjacent the top surface of the elongate member, the pliant foam traction member covering substantially all of the top surface; and a first channel group including a plurality of spaced apart elongate channels extending lengthwise along the bottom surface of the elongate member, the elongate channels of the first channel group being open to a leading end and a trailing end of the apparatus, the elongate channels of the first channel group being formed in an internal region of the bottom surface and not intersecting an outer edge of the elongate member;

wherein the bottom surface adjacent each of the elongate channels of the first channel group is substantially planar; and wherein the apparatus does not include bindings to secure the feet of a rider.

22. The snow-gliding apparatus of claim 21, further comprising:

a second channel group including a plurality of spaced apart elongate channels extending lengthwise along the bottom surface of the elongate member, the elongate channels of the second channel group being open to a leading end and a trailing end of the apparatus, the elongate channels of the second channel group intersecting an end edge of the elongate member.

23. A snow-gliding apparatus, comprising:

an elongate member including an intermediate portion positioned between a pair of upturned end portions, the intermediate portion including a bottom surface with a substantially planar bottom region configured to slide over snow;

a pliant foam traction member mounted adjacent a top surface of the elongate member, and extending to substantially cover the intermediate portion and each of the upturned end portions of the elongate member, such that a rider's feet will contact the traction member when the feet are placed at substantially any location on the upturned end portions and intermediate portion; and a channel extending lengthwise at least partially along the bottom surface of the elongate member, the channel being configured to guide the elongate member over snow;

wherein the apparatus does not include bindings to secure the feet of a rider.

24. The gliding apparatus of claim 23, wherein the traction member is a continuous sheet.

25. The gliding apparatus of claim 23, wherein the traction member is perforated.

26. The gliding apparatus of claim 23, wherein the traction member includes one or more gaps.

* * * * *

UNITED STATES PATENT AND TRADEMARK OFFICE

CERTIFICATE OF CORRECTION

PATENT NO. : 6,290,249 B1
DATED : September 18, 2001
INVENTOR(S) : Andrew Wolf

It is certified that error appears in the above-identified patent and that said Letters Patent is hereby corrected as shown below:

Column 6,
Lines 46, 50, and 52, please replace "surfaces" with -- surface --.

Column 7,
Line 52, please replace "channels" with -- channel --.

Column 8,
Line 3, please replace "the", the first time it appears, with -- The --.

Signed and Sealed this

Fifth Day of March, 2002

*Attest:*

*Attesting Officer*

JAMES E. ROGAN
*Director of the United States Patent and Trademark Office*